United States Patent [19]

Williams et al.

[11] 4,150,745

[45] Apr. 24, 1979

[54] BELT PACKAGING TRAY

[75] Inventors: Larry J. Williams, Waverly; Alvin A. Brhel, Lincoln, both of Nebr.

[73] Assignee: The Goodyear Tire & Rubber Company, Akron, Ohio

[21] Appl. No.: 892,547

[22] Filed: Apr. 3, 1978

[51] Int. Cl.[2] ..... B65D 85/02; B65D 1/34; B65D 81/16; B65D 85/62

[52] U.S. Cl. ..... 206/303; 206/518; 206/563; 229/2.5

[58] Field of Search ..... 206/563, 303, 408, 517, 206/511, 307, 389, 518; 229/2.5; 217/25.5

[56] References Cited

U.S. PATENT DOCUMENTS

| | | | |
|---|---|---|---|
| 2,481,285 | 9/1949 | Bossmeyer | 206/307 |
| 2,654,473 | 10/1953 | Pierce | 206/517 |
| 3,685,646 | 8/1972 | Sy | 206/408 |
| 3,942,637 | 3/1976 | Glennie | 206/408 |

*Primary Examiner*—William T. Dixson, Jr.
*Attorney, Agent, or Firm*—L. A. Germain

[57] ABSTRACT

A packaging tray for holding and storing a group of endless belts in a nested configuration is of a molded plastic having a raised land area and a recessed well area, the land area defining the shape of the tray and the shape of the well, which well maintains the belts in their nested orientation when packed for shipping.

10 Claims, 6 Drawing Figures

BELT PACKAGING TRAY

This invention generally relates to product packaging and more specifically to a tray configuration that facilitates handling, packaging and shipping of a plurality of flexible elastomeric belts.

Presently, upon completion of the manufacturing process, an operator assembles a plurality of flexible endless-loop belts into a nest-like arrangement on a piece of flat board which may be a heavy cardboard or chipboard or the like, and while physically confining the nested belts on the board places them into a shipping container. A plurality of such nested belts are loaded into the shipping container in tiers separated by the pieces of board and when a sufficient number are packed in the container it is sealed and shipped. It must be realized that the nested belts, upon being placed into the container, spring outwardly to meet the side walls of the container and are thus held in a horizontal position by the container side walls and are held in a vertical position by the pieces of board above and below each tier.

Various problems have resulted from this simple packing technique and of a concern is the fact that an operator must consciously control the nested belts because of their tendency to spring apart. This tendency is due in part to being shaped in a nested configuration that is smaller than the wall confines of the shipping container. Thus, any unconscious let up of the nested belts prior to being placed inside of the shipping container may result in their springing out of the nest position. The operator must then take additional time to re-do the nest. Furthermmore, upon placing the belts into the shipping container, care must be exercised so that the nest arrangement does not become disorganized before the next tray is placed in the container because the underlying belts may be creased or crushed into a shape that weakens operation integrity in their intended use.

Another problem of concern that has become apparent with the present belt packaging procedure relates to the fact that the belts tend to shift within the free space of a tier and may get intermingled should the container be accidentally dropped. In this circumstance, and upon unpacking the belts, additional time is required to unscramble the belts before they may be used.

Another and more serious problem of concern results upon opening of the container by the customer. In this process one end is removed by cutting the top, sides and bottom with a razor knife in much the same manner as grocers do when displaying boxed grocery goods. Because the knife penetrates the container, belts within may be damaged by careless cutting. Obviously the belts at the top and bottom of the container may be protected by placing one of the tier boards at the bottom and top of the container. However, when the sides of the shipping container are cut, any belts that are touching the sides thereof may also be cut by the razor knife as it penetrates the container sidewall. As herebefore mentioned, the belts are normally nested in a configuration smaller than that of the sidewall confines of the container and upon being placed herein tend to spring outwardly to meet the container walls. Thus, many of the belts may be abutting the container walls at the point where the razor knife cuts through and therefore one or a plurality of the belts may be cut by the knife. In this circumstance, extra precaution must be taken when opening the shipping container and the belts must be inspected for such cuts before they may be used. In some instances the cuts are not easily detected and defective belts are put into their intended application, as for example, as drum drive belts on clothes dryers. When such defective belts are put into use, premature failure results and early service calls are required to replace the broken belts. This problem is therefore very costly to the manufacturer of the equipment using the belts and to the retainer selling the equipment to the consumer and also creates much customer dissatisfaction because of the early breakdown of the equipment and the costs of service to replace broken belts.

An object of the present invention therefore is to provide a packaging tray configuration for flexible endless belts that facilitates nesting of a pluralty of the belts and saves handling effort and packaging time upon preparation for shipment.

It is a further object to provide a packaging tray that protects the belts within a shipping container so that they are maintained in a nested orientation and cannot be cut when the shipping container is opened by a razor knife.

Another object is to provide a packaging tray for endles flexible belts that may be nested one inside of the other when empty of belts such that a plurality of the trays may be economically returned for re-use.

DESCRIPTION OF THE DRAWINGS

These objects and advantages will be understood from the following description of the invention and the accompanying drawings wherein.

BRIEF DESCRIPTION OF THE INVENTION

Figure 1:
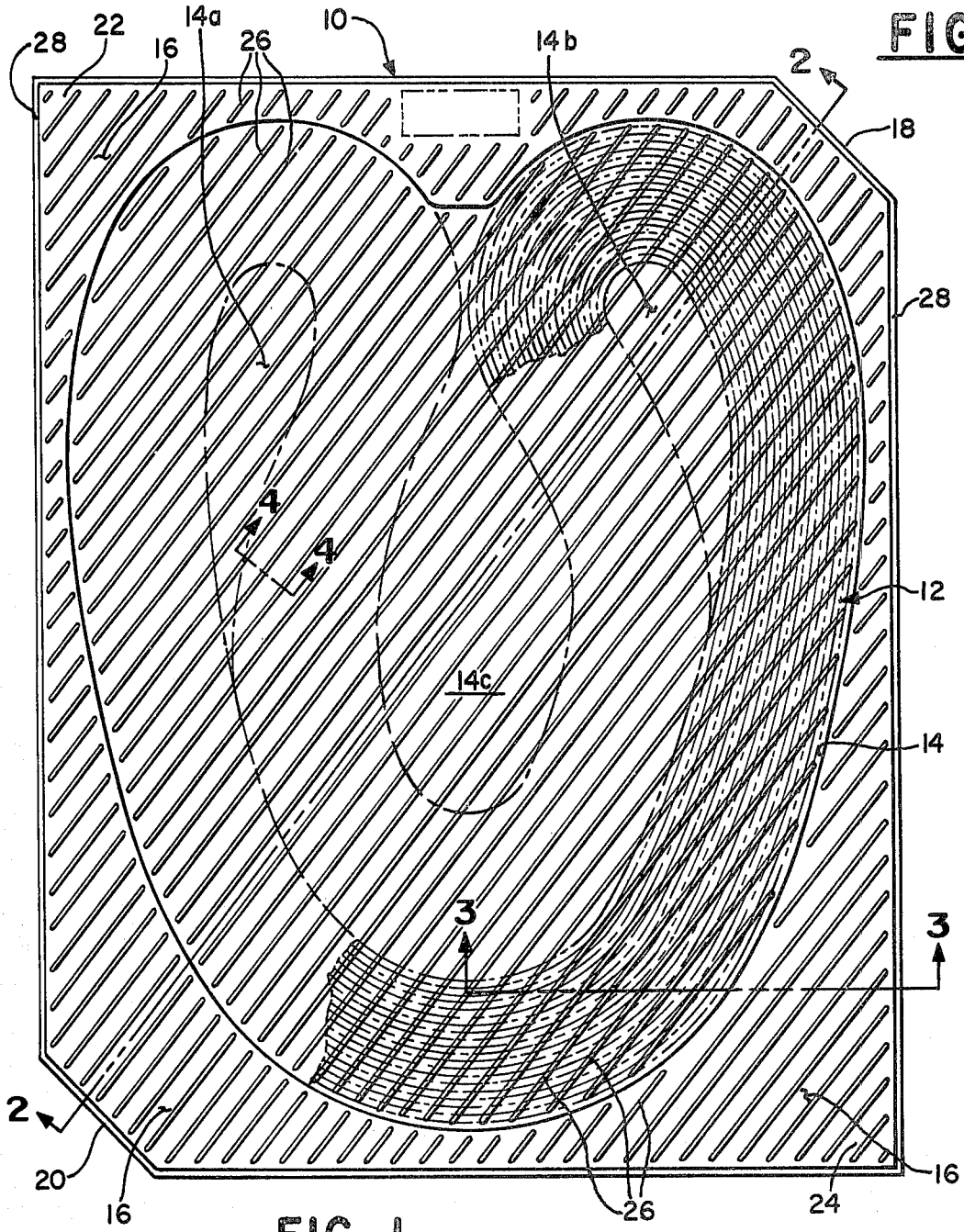
FIG. 1 is a plan view of the belt packaging tray comprising the invention showing a plurality of nested belts therein in ghost lines.
Figure 2:
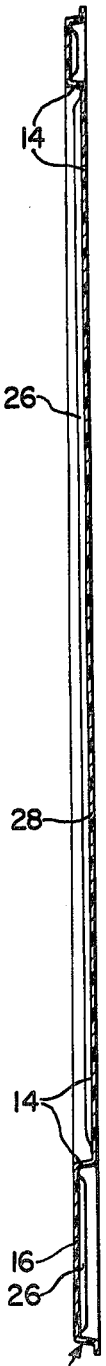
FIG. 2 is an elevational sectional view of the tray taken on line 2—2 of FIG. 1.
Figure 3:
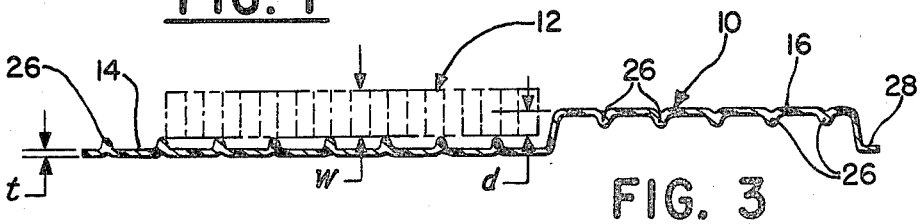
FIG. 3 is an enlarged partial elevational sectional view as taken on line 3—3 of FIG. 1.
Figure 4:
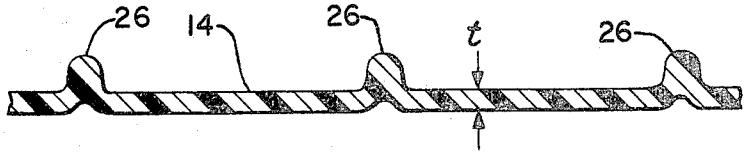
FIG. 4 is a greatly enlarged elevational sectional view showing the configuration of the strengthening ribs which are formed in the tray.

Referring now to the drawings, and in particular to FIGS. 1, 2 and 3 there is illustrated a packaging tray generally indicated by reference numeral 10 that is configured to hold a plurality of flexible endless belts shown in ghost lines and generally indicated by reference numeral 12.

The tray 10 is shown as being substantially rectangular in shape but may as well be square, oval or round depending upon the shape of the shipping container into which the trays will ultimately be placed. The tray is characterized by a well area 14 that approximates the shape of a heart for receiving a plurality of the belts 12 therein, the belts taking the shape of a heart by reason of their being endless and the manner of arrangement for shipping. Of course other well configurations may be used dependent upon the size and type of belt to be shipped. As evident from the showing of FIG. 1 the belts 12 are maintained in the well area 14 in a manner such that there are no sharp bends or turns and thus are kept as close to their intended shape as possible. The tray 10 is further characterized by a land area 16 that encircles and essentially defines the well area 14 of the tray. The amount of land area and its shape may vary and will depend on the strength requirements imposed on the tray and the ultimate size of the shipping container that will carry the trays. The depth "d" of the well area 14 is slightly less than the transverse width "w" of the belts 12 and the reason for this is so that when the trays are stacked in tiers within the shipping container the bottom of the tray above rests on the nested belts below and thus effects holding of the belts in their orientation within the tray well 14. This aspect of the invention is clearly illustrated in FIG. 5 of the drawings. Further, and to facilitate handling of the trays, at least two opposing corners of the tray are truncated such as at 18 and 20. Thus, when the tray 10 of FIG. 1 is confined to a rectangular shipping container it may be readily handled by reason of the hand holds provided when two opposing corners 18 and 20 are truncated. Whether or not all four corners of the tray are used as hand holds will depend upon the strength of the tray and the type of reinforcing that may be provided. For example, FIG. 1 illustrates the tray with diagonal ribs 26 that are oriented in the direction of the hand holds 18 and 20. In this circumstance, the ribs 26 reinforce the tray structure when it is handled at the opposing corners 18 and 20. Obviously, with diagonal ribs as shown, no structural reinforcment is provided in the direction of corners 22 and 24 and therefore it would not be advisable to provide hand holds at these corners. If, however, the rib orientation were of a circular pattern, a star type pattern or any other imaginable pattern that would provide strengthening rubs in alignment with the direction of the hand holds, then it wouldn't make any difference from which direction the tray was handled because its strength integrity would not be compromised by the absence of strengthening ribs.

The trays 10 are preferably of a compression, injection or vacuum molded high-impact poly-styrene or other suitable plastic material having a gauge thickness "t" of not less than 5 mils and not more than 30 mils. The gauge "t" will be determined by the strength requirements imposed on the tray in use and whether or not such trays will be reused. For example, a very thin section tray may only survive one shipment and will have to be discarded, thus adding to the shipping costs while a very heavy section tray may be reused a number of times, but will add to the shipping cost by reason of additional weight and the material cost of the tray. Obviously there is an optimum gauge that may be applied for a particular application. Applicants have found that a tray of about 20 mils will handle the belt shipping requirements and may be reused a number of times before having to be replaced. They have further determined that a tray of about 10 mils will handle the intended service requirements but in order to be re-usable such a tray gauge requires that strengthening ribs 26 be molded into the configuration. The ribs 26 may have any desired spacing but there must be sufficient of them to keep the tray from buckling when loaded with belts and handled at the corners 18 and 20.

It is anticipated that further land area may be molded into the tray configuration. Such additional land areas may be positioned for example, in the areas indicated by reference numerals 14*a*, 14*b* and 14*c* in FIG. 1. Such additional land areas may be useful in strengthening an otherwise flimsy tray but on the other hand may increase the costs of manufacturing the tray. Furtheremore, in a thin gauge tray design the orientation of the strengthening ribs 26 is made more complicated. Such additional land areas may also make it more difficult for an operator to align the plurality of nested belts within the well area and therefore increase the time and costs of packaging the belts. In any case, it is recognized that various trade-offs will have to be made between the tray material gauge and the amount and orientation of any strengthening ribs.

Figure 5:
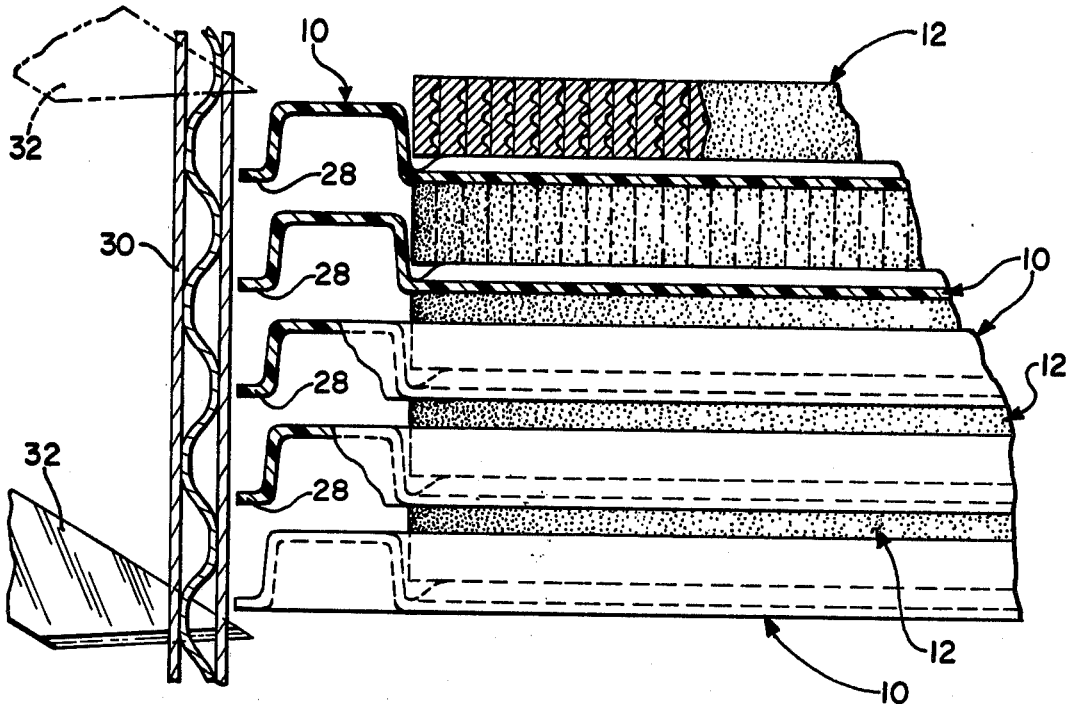
FIG. 5 is a partial elevational sectional view of a plurality of trays of belts showing them as they would be stacked within a shipping container.

As earlier mentioned, a problem with the present technique of shipping flexible belts resides in their being cut upon opening of the shipping container. The tray of this invention eliminates this problem by reason of a border edge 28 that abuts the shipping container wall 30 as illustrated in FIG. 5. Thus, when a razor knife 32 penetrates the container wall 30 it may also cut into the tray edge 28 but this will have no effect on the belts 12 as they are positioned within the tray wall 14 a safe distance from a knife penetration. It has been determined that trays having a gauge "t" of 10 mils may be cut numerous times without affecting the strength integrity of the tray upon re-use.

Figure 6:
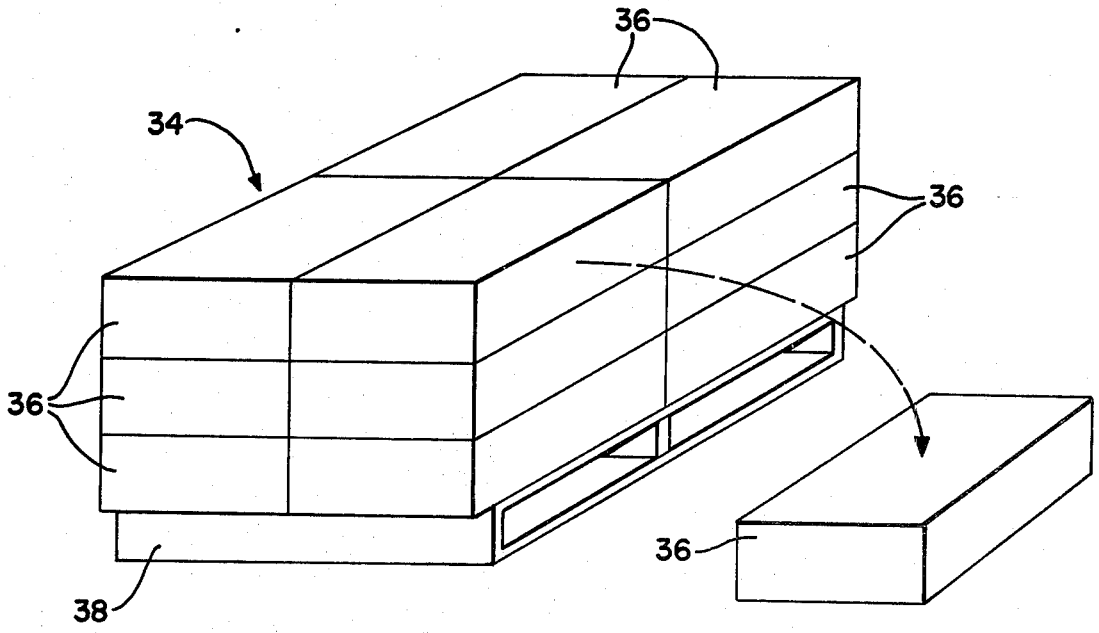
FIG. 6 is a diagrammatic perspective view illustrating the economics of recycling the trays for reuse.

Turning now to FIG. 6, the economics of the invention are illustrated by way of an example. As herebefore mentioned, a plurality of endless flexible belts 12 are placed in the well area 14 of a packaging tray and the number of such belts will depend on their type and size but for the purpose of this example assume that a tray 10 will handle about twenty belts. Further, and for the purpose of this example, assume that shipping containers 36 are provided that will carry about thirty trays of belts each. For shipping, the containers 36 are stacked on a skid 38 which will accommodate about a dozen of the containers. Thus, in a single one skid shipment generally indicated by reference numeral 34, approximately 7,200 belts may be easily handled. Upon using up the belts, the customer stacks the empty trays one inside the other in a nesting arrangement and it has been determined that all of the trays that were used to ship the 7,200 belts may easily fill one-half of a shipping container 36. In this circumstance, upon returning of the trays for re-use, a single shipping container 36 may be used and it will accommodate about seven hundred trays or the number that were first shipped via two skids in two dozen containers 36.

While certain representative embodiments and details have been shown for the purpose of illustrating the invention, it will be apparent to those skilled in this art that various changes and modifications may be made therein without departing from the spirit or scope of the invention.

What is claimed is:

1. A packaging tray comprising a vacuum molded polystyrene carrier having a raised land area and a recessed well area, the land area defining the shape of the tray and the configuration of the well, said well being substantially heart-shaped to receive a plurality of flexible endless belts in a looped configuration therein with the ends of the loop being retained in lobe portions of the heart shape and maintaining said belts in a nested orientation therein, the depth of the well being slightly less than the transverse width of a belt so that when trays of belts are vertically stacked the belts within the tray well are maintained in their nested orientation by the bottom of the tray above it, the gauge of the carrier being within the range of 5–30 mils and having at least two corners truncated such as to provide hand-hold positions in the handling of the tray.

2. A tray as set forth in claim 1 wherein the overall shape of the tray is substantially rectangular.

3. A tray as set forth in claim 1 wherein the overall shape of the tray is square.

4. A tray as set forth in claim 1 wherein the molded cross sectional thickness is 20 mils.

5. The tray as set forth in claim 1 wherein the strengthening ribs are oriented in a substantially circular pattern within the well area while the land area of the tray has radial ribs radiating outwardly from a point at the geometric center of the well area.

6. The tray as set forth in claim 1 wherein an additional land area is provided within the center of the well area at a position such as to further define the two lobes of the heart shape.

7. The tray as set forth in claim 6 wherein additional land areas are provided within the well area and at the approximate position of the center of each lobe such that the belts nested therein are looped about the land areas.

8. The tray as set forth in claim 1 wherein the gauge of the polystyrene is at least 10 mils and is characterized by a plurality of molded-in ribs that provide strengthening of the carrier.

9. The tray as set forth in claim 8 wherein two opposing corners of the tray are truncated and the ribs are oriented in line with the truncated corners.

10. The tray as set forth in claim 8 wherein four corners of the tray are truncated and the ribs are oriented in a circular pattern radiating outwardly from the geometric center of the well area.

* * * * *